United States Patent [19]

Hofsäss

[11] 4,306,211

[45] Dec. 15, 1981

[54] HEAT OPERATED PROTECTIVE SWITCH

[76] Inventor: Peter Hofsäss, Strietweg 45, D-7530 Pforzheim, Fed. Rep. of Germany

[21] Appl. No.: 145,572

[22] Filed: Apr. 30, 1980

[30] Foreign Application Priority Data

Apr. 30, 1979 [DE] Fed. Rep. of Germany ..... 2917482

[51] Int. Cl.[3] ..... H01H 61/00

[52] U.S. Cl. ..... 337/89; 337/365; 337/380

[58] Field of Search ..... 337/53, 85, 89, 343, 337/362, 365, 369, 370, 372, 380

[56] References Cited

U.S. PATENT DOCUMENTS 4,149,138 4/1979 Pevzner et al. ..... 337/372

4,157,525 6/1979 Grable ..... 337/365

*Primary Examiner*—George Harris

*Attorney, Agent, or Firm*—Craig and Antonelli

[57] ABSTRACT

A heat operated protective switch, with a housing, with a bimetallic snap disc guided peripherally in the housing, with a contact adapted to be operated by the bimetallic snap disc, and also with an associated contact. The contact and the associated contact are connected in electrically conductive manner to one another by way of contact surfaces in a low temperature position while when a predetermined temperature is exceeded the bimetallic snap disc snaps over into a high temperature position and lifts the contact away from the associated contact. The contact has a circumferential edge whereby its contact surface coming into contact with the associated contact is set off sharply from the bimetallic disc. Thus operationally caused impairment of the switch-over behavior of the bimetallic snap disc, more particularly impairment caused by switching sparking is obviated.

14 Claims, 2 Drawing Figures

HEAT OPERATED PROTECTIVE SWITCH

Figure 1:
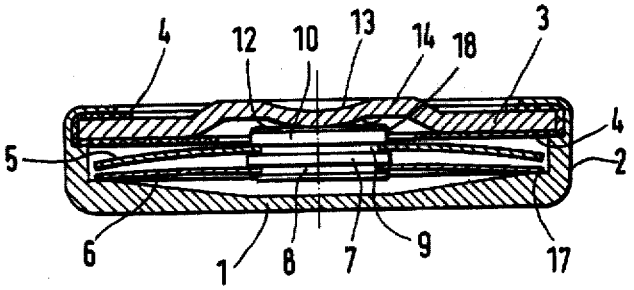

The invention relates to a heat operated protective switch, with a housing, with a bimetallic snap disc, with a contact adapted to be operated by the bimetallic snap disc, and also with a counter-contact or associated contact, contact and associated contact being in electrically conductive connection with one another via contact surfaces in a low temperature position whereas when a predetermined temperature is exceeded the bimetallic snap disc snaps over into a high temperature position and lifts the contact away from the associated contact.

Such heat operated protective switches are incorporated in electrical circuits in many different kinds of electrical appliances, more especially in electrical heating apparatus. In the normal low temperature position of the switch the latter is closed so that the current being monitored flows, whereas if the temperature rises above a predetermined value, the bimetallic snap disc snaps over so that the flow of current through the switch and thus the supply of energy to the monitored apparatus is interrupted. In a very simple constructional form of heat operated protective switches of the category described a special current transmitting element is not provided, so that in the low temperature position the current to be monitored flows via the bimetallic snap disc, which is disadvantageous since the current loading of the bimetallic snap disc influences the switching behaviour thereof. In known heat operated protective switches (cf. German Pat. No. 21 21 802), with the further development of which the invention is particularly concerned, this is countered by providing a spring snap disc as current transmitting element additionally to the bimetallic snap disc. The current to be controlled flows through an associated contact, contact and spring snap disc, the bimetallic snap disc itself carrying no current. The spring snap disc has less spring force (generally only slightly less) than the bimetallic snap disc, and therefore is pressed into its opposite situation on change-over to the high temperature position. When the temperature drops again, the internal forces in the bimetallic snap disc decline to such an extent that it finally has them overcome by the spring snap disc, and the switch returns to the low temperature position. In these known heat operated protective switches of the category described, current is usually supplied to the actual switching mechanism in that the housing comprises housing base and housing cover and these are connected together in electrically insulated fashion and respectively form the associated contact (integral with the housing) and connect conductively to the contact (through spring or bimetallic snap disc), or vice versa.

In the specified heat operated protective switches described hereinbefore, the contact actuated by the bimetallic snap disc consists of a more or less considerably arched dome which in the low temperature position usually abuts on the plane housing base or cover respectively. This constructional form, which seems an obviously attractive arrangement for reasons of manufacturing technique, has proved to be quite successful in the switching of small currents. But difficulties arise when relatively large currents have to be controlled, or such switches are overloaded. As contact lifts away from associated contact, a switching spark forms, and because of the geometric facts of life in the known heat operated protective switches this switching spark creeps over the contact dome to the bimetallic snap disc. The high electrical field intensities involved result more especially at the edges of the bimetallic snap disc in changes in the elastic properties, perhaps by annealing. These changes at any rate have the disadvantageous effect that the bimetallic snap disc no longer snaps over within a narrowly defined temperature range but changes from the low to the high temperature position with a "creeping" action within a wide temperature range, so that a precise switch-over temperature is no longer observed.

The invention has as its object to develop further a heat operated protective switch of the type initially described in such a manner as to obviate operationally caused impairment of the switch-over behaviour of the bimetallic snap disc, more particularly impairment caused by switching sparking.

According to the invention this object is achieved in that the contact has a circumferential rim or edge whereby its contact surface coming into contact with the associated contact is sharply set off relatively to the bimetallic disc. Because of the edge any switching spark which may occur remains adhering to the said edge and does not reach the bimetallic disc.

The mobile contact is usually formed of a stud which extends through a central aperture of the bimetallic snap disc. In such a constructional form the invention proposes that the contact is formed of a collar of the stud engaging over the aperture of the bimetallic snap disc in the circumferential region. In the first instance the result is achieved that a switching spark, if it should in fact stick to the contact, at any rate is held fast at the collar edge and does not transfer to the bimetallic snap disc. There are also assembly technique advantages from the fact that the bimetallic snap disc is held fast by the collar and can be assembled together with the stud as a sub-assembly. This is further improved if the bimetallic snap disc is fixed between collar and stud in the axial sense also—of course with an amount of play appropriate to manufacturing conditions and function—and the collar and the stud are connected by means of a pin formed on the collar and extending through an axial aperture of the stud. There are various possibilities open for securing the pin in the stud, for example pressing-in, upsetting, grooved rivet construction, etc. The pin formed on the collar can also be rivetted through the stud, which is particularly advantageous if the stud has a special narrowed neck extending through the central aperture of the bimetallic snap disc, so that a certain amount of play is ensured.

As explained initially, the invention proceeds more particularly from a constructional form wherein additionally to the bimetallic snap disc a special current transmitting element in the form of a spring snap disc is provided. The contact is formed in that case of a stud which extends through central apertures of bimetallic snap disc and spring snap disc with a narrowed neck in each case. Proceeding therefrom, the invention proposes that at least the neck extending through the spring snap disc is connected therewith by flanging-over. The collar already discussed, engaging over and holding fast the bimetallic snap disc, can likewise be formed by flanging-over the corresponding neck, as far as this can be combined with the construction of the contact surface of the movable contact.

According to a preferred constructional form it is proposed that at least the contact surface of the associated contact has a convex curvature, and that the contact surface of the associated contact has a greater amount of curvature than the contact surface of the contact. Within the framework of the invention, "amount of curvature" means the amount of (convex or concave) curvature of the contact surfaces as mathematically defined in the usual way. By the convexly arched construction of the contact surface of the associated contact in conjunction with the, in contrast, relatively smaller curvature of the contact, the invention achieves the result that a switching spark does not transfer to the contact (which is connected to the bimetallic snap disc) but remains on the associated contact, so that the bimetallic snap disc is not impaired by the switching sparking. As regards details, various possibilities exist for the construction of the contact surfaces. Preferably the contact surface of the contact connected with the bimetallic snap disc is of flat construction. In some cases it may also be advantageous to provide the contact with a concavely arched contact surface, achieving a better fit between contact and associated contact with correspondingly reduced current densities, and at the same time transfer of the switching spark to the contact is obviated. In some circumstances it is also sufficient even if the contact is likewise convex but with a smaller curvature than the associated contact.

The associated contact is usually fast with the housing and formed directly by a housing wall. In one such constructional form the invention proposes that the associated contact comprises a cup-shaped recess in the housing wall, which recess is convex relatively to the housing interior and can be formed for example by an appropriate stamping of the housing wall. It is also advantageous to situate the associated contact in the region of a recess forming an outwardly directed projection relative to the housing interior, so as further to reduce the overall height of the heat operated protective switch according to the invention in this way. With this arrangement, the inwardly directed associated contact is surrounded at the outside of the housing by a projecting annular surface formed by the recessing, at which the necessary electrical connection can be made in a simple way when fitting the switch in an apparatus. Associated contact and recess can readily be formed in a single operation by pressing, stamping or the like on the housing cover or base.

Figure 2:
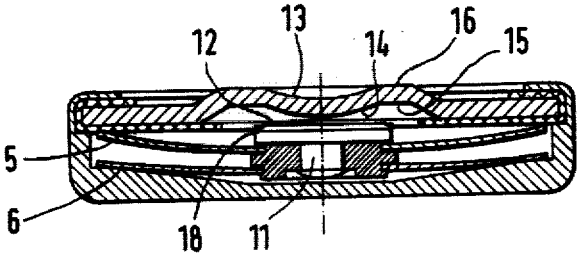

The invention will be explained in detail hereinafter with reference to drawings showing simply constructional examples. In the drawings:

FIG. 1 shows a heat operated protective switch in longitudinal section in the low temperature postion, FIG. 2 shows the subject of FIG. 1 in the high temperature position.

The heat operated protective switch shown in the drawings has in the first instance a housing comprising a housing base 1 with side wall 2 connected thereto, and a housing cover 3, these consisting of electrically satisfactorily conductive material. The housing cover 3 is inserted in the opening of the side wall 2 with interposition of an electrical insulation 4, and secured by flanging-over, so that the housing interior is closed in sealing-tight manner. The switching mechanism arranged in the interior of the housing comprises substantially a bimetallic snap disc 5, a spring snap disc 6 and a stud 7 which with one narrowed neck in each case extends through central apertures in the bimetallic disc 5 and spring snap disc 6. The lower neck 8, projecting through the spring snap disc 6, is flanged-over so that the spring snap disc 6 and the stud 7 are connected together in shape-locking manner. On the upper neck 9 extending through the bimetallic snap disc 5, there is provided a collar 10 which engages over the bimetallic snap disc 5, so that the latter also is connected positively to the stud 7. Thus the switching mechanism forms a coherent unit which can be pre-assembled in a simple manner and inserted in the housing. The collar 10 comprises at its underside a pin 11 which extends through an aperture of the stud 7 and is rivetted thereto.

The collar 10 forms a movable contact which is adapted to be operated by bimetallic and spring snap discs 5, 6 and whose contact surface 12 in the illustrated constructional example is plane in configuration, i.e. has zero curvature.

Allocated to the movable contact formed by the collar 10 is an associated contact which is integral with the housing and which comprises a cup-shaped recess 13 in the housing cover 3. The contact surface 14 of the associated contact is arched convexly with respect to the interior of the housing and therefore relatively to the movable contact. The recess 13 forming the associated contact and projecting towards the housing interior is situated in the region of a frustoconical recess 15 projecting outwardly from the housing interior, and is thus surrounded by an outwardly projecting annular contact 16 surface.

Electrical connection for the heat operated protective switch in the fitted state is provided directly by way of the housing base 1 on the one hand and the housing cover 3 on the other, these consisting of electrically conductive material (for example a suitable metal plated with silver) and being insulated electrically from one another. In the low temperature position shown in FIG. 1 the spring snap disc 6 abuts peripherally in electrically conductive manner on an abutment provided at the housing base 1, and by virtue of its spring force presses the movable contact surface 12 of the collar 10 against the fixed contact surface 14 of the cup-shaped recess 14 provided at the housing cover 3, so that the switch is closed. In this position the bimetallic snap disc 5 held on the stud 7 is free of forces. If a predetermined temperature is exceeded, the bimetallic snap disc 5 snaps over into the high temperature position shown in FIG. 2. The bimetallic snap disc in this position bears peripherally on the insulation 4 and presses the stud 7 downwardly, overcoming the spring force of the spring snap disc 6, so that the movable contact surface 12 is lifted from the fixed contact surface 14, and the flow of current through the heat operated protective switch is interrupted. As soon as the temperature returns below the predetermined temperature, the internal forces of the bimetallic snap disc 5 decline, until finally they are overcome by the spring snap disc 6, and the switching mechanism returns to the low temperature position shown in FIG. 1.

Since, as shown, the edge 18 of collar 10 sharply offsets contact surface 12 from the bimetallic snap disc 5, any switching spark occurring during the above-noted operation will not pass over to the bimetallic disc.

I claim:

1. In a thermal protection switch of the type having a housing, a bimetallic snap-action disc guided within the housing, a first electrical contact, a second cooperating electrical contact, said first contact being actuated by said bimetallic snap-action switch in a manner for placing said contacts in electrically conductive connection with each other and for terminating said electrically conductive connection upon exposure of said bimetallic snap-action switch to temperatures exceeding a predetermined value, the improvement comprising means for preventing switching arcs occurring between said contacts from both damaging or changing the snap-action properties of said bimetallic disc due to contacting of said bimetallic disc by said arc and high strength electrical fields thereof.

2. A thermal protection switch according to claim 1, wherein said means for preventing comprises said first electrical contact being formed with a contact surface for contacting said cooperating contact to produce said electrically conductive connection and a peripheral edge surrounding said contact surface in a manner sharply offsetting said contact surface from said bimetallic disc.

3. Thermal protector switch according to claim 2, wherein said first contact comprises a pin penetrating a central cutout of the bimetallic snap-action disc, and a collar thereon, the periphery of said collar extending over the cutout of the bimetallic snap-action disc.

4. Thermal protector switch according to claim 3, wherein the bimetallic snap-action disc is fixedly mounted axially between the collar and the pin, and said collar and said pin are joined together by means of a stud formed on the collar and penetrating an axial recess of the pin.

5. Thermal protector switch according to claim 3 or 4, comprising a snap-action spring disc connected to the first contact as a current-transmitting member, wherein said pin penetrates a central cutout of the snap-action spring disc with a tapered shoulder, said shoulder penetrating the snap-action spring disc being connected to the pin by an overlapping flange.

6. Thermal protector switch according to claim 5, wherein the contact surface of the second, cooperating contact has a convex curvature, and that the amount of curvature of the contact surface of the cooperating contact is larger than the amount of curvature of the contact surface of the first contact.

7. Thermal protector switch according to claim 2 or 3 or 4, wherein the contact surface of the second cooperating contact has a convex curvature, and that the amount of curvature of the contact surface of the cooperating contact is larger than the amount of curvature of the contact surface of the first contact.

8. Thermal protector switch according to claim 6, characterized in that the contact surface of the first contact is planar.

9. Thermal protector switch according to claim 7, characterized in that the contact surface of the first contact is planar.

10. Thermal protector switch according to claim 6, characterized in that the contact surface of the first contact is curved in a concave fashion.

11. Thermal protector switch according to claim 6, characterized in that the contact surface of the first contact is curved in a concave fashion.

12. Thermal protector switch according to claim 6, wherein the second cooperating contact is constituted by a housing wall, and said convex curvature of cooperating contact consists of a spherical indentation of the housing wall that is convex with respect to the interior of the housing.

13. Thermal protector switch according to claim 9, wherein the second cooperating contact is constituted by a housing wall, and said convex curvature of cooperating contact consists of a spherical indentation of the housing wall that is convex with respect to the interior of the housing.

14. Thermal protector switch according to claim 12, wherein a second indentation which projects toward the outside of said housing is arranged about said spherical indentation so as to form an exterior contact.

* * * * *